US011057695B2

(12) United States Patent
Williams et al.

(10) Patent No.: US 11,057,695 B2
(45) Date of Patent: Jul. 6, 2021

(54) IN-EAR HEADPHONE DEVICE WITH ACTIVE NOISE CONTROL

(71) Applicant: TYMPHANY ACOUSTIC TECHNOLOGY (HUIZHOU) CO., LTD., Huizhou (CN)

(72) Inventors: Rowan Dylan Gower Williams, Huizhou (CN); Thomas Pieter J. Peeters, Huizhou (CN); Chih-Hung Chen, Huizhou (CN)

(73) Assignee: Tymphany Acoustic Technology (Huizhou) Co., Ltd., Huizhou (CN)

( * ) Notice: Subject to any disclaimer, the term of this patent is extended or adjusted under 35 U.S.C. 154(b) by 0 days.

(21) Appl. No.: 16/837,013

(22) Filed: Apr. 1, 2020

(65) Prior Publication Data

US 2020/0322712 A1 Oct. 8, 2020

Related U.S. Application Data

(60) Provisional application No. 62/828,111, filed on Apr. 2, 2019.

(51) Int. Cl.

| | |
|---|---|
| ***H04R 25/00*** | (2006.01) |
| ***H04R 1/10*** | (2006.01) |
| ***G10K 11/178*** | (2006.01) |

(52) U.S. Cl.

CPC ..... *H04R 1/1083* (2013.01); *G10K 11/17873* (2018.01); *H04R 1/1016* (2013.01); *H04R 1/1075* (2013.01)

(58) Field of Classification Search

CPC .. H04R 1/1083; H04R 1/1016; H04R 1/1075; G10K 11/17873

See application file for complete search history.

(56) References Cited

U.S. PATENT DOCUMENTS

| | | | | |
|---|---|---|---|---|
| 7,466,838 | B1 * | 12/2008 | Moseley | G10K 11/17857 381/370 |
| 9,934,774 | B1 * | 4/2018 | Lin | G10K 11/17881 |
| 2011/0014957 | A1 * | 1/2011 | Sugimori | H04R 1/1041 455/569.1 |
| 2018/0070185 | A1 * | 3/2018 | Pedersen | H04R 25/407 |

* cited by examiner

*Primary Examiner* — Simon King

(74) *Attorney, Agent, or Firm* — Muncy, Geissler, Olds & Lowe, P.C.

(57) ABSTRACT

The present disclosure provides an in-ear headphone device including a loudspeaker having a loudspeaker diaphragm and a microphone, wherein the device is arranged to provide a noise cancelling audio signal to the loudspeaker. The loudspeaker and microphone are acoustically coupled within a device housing, and the device includes an acoustic tube coupling the device to an ear canal of a user. The acoustic tube is associated with an acoustic tube axis defining a projection plane perpendicular to the acoustic tube axis. The loudspeaker and microphone are arranged such that a projection area of the loudspeaker diaphragm onto the projection plane and a projection area of the microphone onto the projection plane are non-intersecting. The disclosure further provides an in-ear headphone device set including a first and a second in-ear headphone device.

29 Claims, 3 Drawing Sheets

IN-EAR HEADPHONE DEVICE WITH ACTIVE NOISE CONTROL

CROSS-REFERENCE(S)

This application claims priority to and benefit of U.S. Provisional Application No. 62/828,111, filed on Apr. 2, 2019, the content of which is hereby incorporated by reference in its entirety.

FIELD OF THE DISCLOSURE

The present disclosure generally relates to an in-ear headphone device with active noise control.

BACKGROUND

Headphones for reproduction of sound come in various types such as over-the-ear headphones, on-ear headphones, or in-ear headphones. In-ear headphones may extend into the ear canals of the user wearing the headphone.

Some headphones of the abovementioned headphone types may further include a microphone arranged to record sound, such as sound external to the headphone or sound present within a closed or concealed volume in front of the ear canal of the user wearing the headphone. Such recording of sound may be used for tele communicative purposes or may be used for active noise control.

Challenges exist relative to the implementation of active noise control in in-ear headphone devices, where size restrictions of headphone components, quality of components, and stability of the headphone has to be carefully balanced in order to deliver both a quality sound experience more generally a pleasant user experience to the user of the headphone.

SUMMARY

The present disclosure includes in-ear headphone designs that may address these challenges related to active noise control in conventional in-ear headphone devices. In some cases, the presently disclosed embodiments may increase perceived audio quality while at the same time ensuring a high stability of the headphone device when in use.

One aspect of the disclosure may include an in-ear headphone device including:

a device housing, a loudspeaker and a microphone;

wherein said device housing is arranged to be fitted into an outer ear of a user such that said device housing extends into an ear canal of said user;

wherein said microphone is arranged to detect an in-ear audio signal, and wherein said in-ear headphone device is arranged to process said in-ear audio signal to provide a noise cancelling audio signal to said loudspeaker;

wherein said loudspeaker and said microphone are acoustically coupled within said device housing;

said device housing includes an acoustic tube acoustically coupling said loudspeaker to said ear canal of said user when said device housing is fitted into said outer ear of said user, wherein said acoustic tube is associated with an acoustic tube axis extending into said ear canal, said acoustic tube axis defining a component projection plane perpendicular to said acoustic tube axis;

said loudspeaker includes a loudspeaker diaphragm associated with a loudspeaker diaphragm projection area, wherein said loudspeaker diaphragm projection area is defined as a projection of said loudspeaker diaphragm along said acoustic tube axis onto said component projection plane; and said microphone includes a microphone transducer associated with a microphone transducer projection area, wherein said microphone transducer projection area is defined as a projection of said microphone transducer along said acoustic tube axis onto said component projection plane;

said loudspeaker diaphragm projection area and microphone transducer projection area are non-intersecting in said component projection plane.

An "in-ear headphone" device may include a headphone device arranged to be worn by a user by fitting the device in the user's outer ear, such as on the pinna (earflap). An in-ear headphone device may also include an earbud. An in-ear headphone device may also include a hearable. The in-ear headphone device may further extend at least partially into the ear canal of the user. The in-ear headphone device may be shaped to fit at least partly within the outer ear and/or the ear canal, thereby ensuring fitting of the device to the user's ear. The in-ear headphone device may use other means to fasten the device to the user's ear, such as a band, a strap, a clip, or a wrap. The in-ear headphone device may extend into the user's ear canal using an acoustic tube which may be formed as an integral part of the device housing.

The in-ear headphone device may allow the user to listen to an audio source, with minimal sound being emitted to the surroundings of the user. Thus, the in-ear headphone device may be used for listening to media, such as music, or for telecommunication.

The in-ear headphone device may include a device housing in which a loudspeaker and a microphone are arranged. The loudspeaker is arranged to produce acoustic sounds which may be substantially emitted into a front acoustic cavity disposed within the device housing. Similarly, the microphone may be arranged to record acoustic sounds (e.g., in-ear audio signals) in said front acoustic cavity.

The device housing may additionally include a rear acoustic cavity, which may not be coupled to the front acoustic cavity.

The front acoustic cavity may further include a cavity segment disposed within the acoustic tube; however, the front acoustic cavity need not (and in some cases does not) extend outside the device housing. As the device is worn by the user, an ear acoustic cavity is formed, which may include the front acoustic cavity and the ear canal, ending at the ear drum. The environment outside the ear acoustic cavity and outside the device housing may be referred to as the external acoustic environment.

Generally, the technical field of in-ear headphone devices is distinct from the technical fields of on-ear headphone devices and over-ear headphone devices, because the volumes of the involved acoustical cavities (e.g., the front acoustic cavity) are much smaller for in-ear headphone devices. Thus, the acoustic environment in the front acoustic cavity is different from the acoustic environments of the other types of headphones. For example, compared to other types of headphone devices, different impedances and directionality of acoustic sounds emitted by the loudspeaker may be appropriate for in-ear headphone devices. Furthermore, in-ear headphone devices typically have stricter size restrictions in comparison with other headphone devices, because an in-ear headphone device may rely on a fit with the outer ear of the user. Therefore, the selection of key components (e.g., loudspeaker, etc.) may be limited.

"Sound" may include an audible pressure wave, and a loudspeaker may generate sound by pushing air to create a pressure wave. Typically, the air is pushed by a loudspeaker diaphragm. A diaphragm may include a movable membrane and may be manufactured with the shape of a cone or a dome. However, the shape and thickness of a diaphragm is not restricted to these examples. Typically, the diaphragm may be moved to create sound by an attached voice coil, which may reciprocate when an alternating current is applied due to the presence of a magnetic field in the vicinity of the voice coil.

A microphone may include a device which can transform sound waves into an audio signal, where the audio signal is based on voltages and/or currents. The audio signal may be a digital or analogue audio signal. In order to transform sound waves, microphones generally include a movable component, which may vibrate when sound waves are applied. The vibration may be transformed into the audio signal. A microphone transducer may include a movable component of a microphone. Some types of microphones including a microphone transducer may include condenser microphones, electret microphones, dynamic microphones, ribbon microphones, piezoelectric microphones, or Micro-Electrical-Mechanical System (MEMS) microphones. However, the present disclosure is not limited to these examples.

Active noise control may include a method for reducing unwanted sound by addition of an audio signal which has opposite sound pressure with respect to the unwanted sound. "Active noise control" may also be referred to as "active noise reduction" or "active noise cancellation," and may be thought of as a type of feedback. In some cases, at least one microphone may be used to detect and/or record sound. Based on the detected or recorded sound, a noise cancelling audio signal may be generated which is designed to cancel unwanted sound within the ear of the user by destructive interference. In some cases, this signal is the additive inverse of the unwanted sound and may thus be obtained from the unwanted sound (e.g., by inverting the phase, inverting the polarity, or taking the additive inverse). The noise cancelling audio signal may be emitted as sound by a loudspeaker of the headphone, and thus cancel unwanted sound within the ear of a user. The loudspeaker may simultaneously emit another audio signal (e.g., music or speech), which is substantially unaffected by the active noise control. An audio signal (e.g., music or speech) emitted by the loudspeaker, which is not emitted for purposes of active noise control, may be referred to as a "desired audio signal" in this disclosure.

An in-ear headphone according to the disclosure may include a loudspeaker and a microphone, which are acoustically coupled. Two items being acoustically coupled may indicate that sound waves are able to travel from one item to the other without crossing an acoustic barrier. An acoustic barrier may be an interface between two media, such as air and the device housing.

Active noise control in a headphone may rely on a microphone which is not acoustically coupled to the loudspeaker. Such a microphone may be coupled to the external acoustic environment. This microphone may thus primarily record sound from the outside external acoustic environment, and not from the ear acoustic cavity. Such a microphone arrangement may be able to primarily record unwanted sound outside the ear and not the desired audio signal. Such an arrangement may require simpler signal processing to carry out active noise control.

Alternatively, or additionally, active noise control may rely on a microphone which is acoustically coupled to the loudspeaker. Such a microphone may be coupled to the ear acoustic cavity and therefore may record unwanted sound within the ear as well as the desired audio signal. Such a microphone arrangement may require more complicated signal processing, because the processing may need to distinguish the unwanted noise from the desired audio signal for the active noise control to be performed without affecting the desired audio signal. However, because the microphone may measure the unwanted sound within the ear of the user, these types of systems may be more efficient in cancelling unwanted sound heard by the user. Various embodiments may include both the externally directed microphone for recording ambient sound and the microphone in the ear acoustic cavity for recording the actual in-ear sound, and perform active noise control on the basis of both microphone inputs.

To ensure active noise control of high quality, in some cases, both a microphone and a loudspeaker of high quality may be employed, in order to be able to record and produce the required sound pressure at the required frequencies to substantially match the noise in order cancel it. Unwanted noise to be cancelled may be, for example, relatively low frequency noise, which may necessitate a loudspeaker with good low frequency characteristics to produce a matching negative noise signal. Headphones with acoustically coupled microphone and loudspeaker for active noise control purposes may thus able to deliver superior active noise control compared to headphones with microphone and loudspeaker which are not acoustically coupled, but at the cost of large components and complicated signal processing. Such components are typically large, compared to the size of an in-ear headphone, which may have strict size limitations.

An in-ear headphone according to this disclosure may include a loudspeaker and a microphone acoustically coupled within a device housing. Any suitable microphone and loudspeaker may be used for active noise cancelling purposes. The device housing may include an acoustic tube which may acoustically couple the loudspeaker to the ear canal of a user when the in-ear headphone device is worn. The acoustic tube may extend into the ear canal.

The acoustic tube may have an acoustic tube axis, and the acoustic tube axis may be associated with a component projection plane, which may include any plane perpendicular to the acoustic tube axis. Being "perpendicular" may refer to a component projection plane that forms a right angle with respect to the acoustic tube axis. For example, the angle between the component projection plane and the acoustic tube axis may be 90 degrees or within +/− a few degrees of 90 degrees.

In some embodiments, the acoustic tube may be a hollow cylinder, and the acoustic tube axis may be a straight line about which the cylinder is cylindrically symmetric. In some embodiments, the acoustic tube may include multiple segments, including at least one cylinder segment. In this disclosure, the acoustic tube cylinder may be defined by any cylinder segment.

In other embodiments of the disclosure, the acoustic tube axis may be defined by the acoustic tube outlet. The acoustic tube outlet is the opening where sound produced by said loudspeaker of the in-ear headphone exits the device housing through the acoustic tube. In some embodiments, the acoustic tube axis may intersect the center point of the acoustic tube outlet and the center point of the loudspeaker diaphragm. In some embodiments, the acoustic tube axis may be perpendicular to an acoustic tube outlet plane, where the acoustic tube outlet may lie substantially within the acoustic tube outlet plane.

According to the disclosure, the arranged positions of the loudspeaker and the microphone may have certain specifications when viewed along the acoustic tube axis. The loudspeaker diaphragm may define a loudspeaker diaphragm projection area when projected along the acoustic tube axis onto the component projection plane. Similarly, the microphone transducer may define a microphone transducer projection area when projected along the acoustic tube axis onto the component projection plane. According to the disclosure, the loudspeaker diaphragm projection area and the microphone transducer projection area are non-intersecting. For example, the loudspeaker and microphone may be arranged in a side-by-side manner such that they do not project overlapping areas (e.g., partly or fully overlapping areas) onto the component projection plane.

In this context, if one area lies fully within another area, such that the microphone transducer projection area lies fully within the loudspeaker diaphragm projection area, the two areas may be considered as non-intersecting.

In some embodiments of the disclosure, the speaker may be located near the acoustic tube. The acoustic tube axis may pass through the loudspeaker. For example, the acoustic tube axis may pass through the loudspeaker projection area. The loudspeaker may be arranged with its direction of maximum sound intensity along the acoustic tube axis through the acoustic tube. Whereas the loudspeaker is located on the acoustic tube axis, the microphone may be displaced perpendicularly from the acoustic tube axis. Thus, the diaphragm projection and the microphone projection do not intersect in the component projection plane.

The arrangement of loudspeaker and microphone in the in-ear headphone with active noise control according to the present disclosure may offer several advantageous compared with extant solutions.

Both a loudspeaker and a microphone of high quality are generally required to provide effective active noise control. Such high-quality components, however, are typically large compared with the ear canal of a user and cannot fit within the acoustic tube. Consequently, extant in-ear headphones with active noise control and an acoustically coupled loudspeaker and microphone may suffer from large front acoustic cavity volumes, large distances from the loudspeaker to the eardrum, and large device housing extensions. A large front acoustic cavity volume and a large distance from speaker to the eardrum may significantly reduce the quality and/or intensity of the sound which reaches the eardrum. Furthermore, a large device housing extension may reduce the wearing stability of the device when it is worn, particularly because wearing stability of in-ear headphones rely on a fit with the outer ear of the user, instead of e.g. a band.

Embodiments according to the present disclosure may solve these problems and upgrade the active noise control capabilities. By employing an improved arrangement of the loudspeaker and the microphone, it may be possible to fit in better components, which are typically larger, and thus enhance active noise control of in-ear headphones as well as loudspeaker sound quality. Additionally, it may be possible to significantly reduce the extension of the headphone device along the acoustic tube axis, which may improve the stability of the in-ear worn device. Finally, because the dimensions of the device can be reduced, the volume of air in the front acoustic cavity may be minimized, and the distance from the speaker to the eardrum may be smaller, which can further improve the audio quality experienced by the user.

In some embodiments, said acoustic tube may include an acoustic tube segment shaped as a hollow frustum and said acoustic tube axis may be an axis of said acoustic tube segment.

The acoustic tube may be a hollow tube that serves to channel acoustic sounds generated by the loudspeaker into the ear canal of the user wearing the in-ear headphone device. The acoustic tube, or at least a segment of it, may define an axis as an axis that passes through the hollow interior of the acoustic tube or at least through the hollow interior of the acoustic tube segment. This axis may substantially pass through center points within the interior of the acoustic tube or acoustic tube segment. The center points may be points of symmetry, such as points defining a line of rotational symmetry of the acoustic tube or acoustic tube segment. In this embodiment, the abovementioned axis is the acoustic tube axis.

In some embodiments, the acoustic tube may be shaped as a hollow frustum and said acoustic tube axis is an axis of said acoustic tube.

In some embodiments, said acoustic tube segment may be shaped as a hollow conical frustum.

In some embodiments, the acoustic tube may include an acoustic tube segment shaped as a hollow conical frustum. A conical frustum may include a cone cut by two parallel planes, such that it does not extend outside the parallel planes. A cone has a cone axis which may include a straight line about which the cone has a cylindrical symmetry. A hollow conical frustum may include a conical frustum which is hollow along the cone axis of the cone upon which the hollow conical frustum is based. The axis of a hollow conical frustum may include the cone axis of the cone upon which the hollow conical frustum is based. The acoustic tube axis may be the axis of the acoustic tube segment shaped as a hollow conical frustum.

The cone upon which the hollow conical frustum is based may be only approximately a cone or it may be an elliptical cone, such as a cone which is elongated in one direction parallel to the two parallel planes defining the frustum.

In some embodiments, said acoustic tube may include an acoustic tube segment shaped as a hollow cylinder and said acoustic tube axis is an axis of said acoustic tube segment.

The acoustic tube may include an acoustic tube segment which is shaped as a hollow cylinder. A cylinder has a cylinder axis which may include a straight line about which the cylinder has a cylindrical symmetry. The axis of a hollow cylinder may include the cylinder axis of the cylinder upon which the hollow cylinder is based. The cylinder upon which the hollow cylinder is based may be only approximately a cylinder or it may be an elliptical cylinder. The acoustic tube axis may be the axis of the segment shaped as a hollow cylinder.

In some embodiments, the acoustic tube may be shaped as a hollow cylinder and said acoustic tube axis is an axis of said acoustic tube.

In some embodiments, said acoustic tube may include an acoustic tube outlet having a center point, wherein said loudspeaker diaphragm may include a loudspeaker diaphragm center point, and wherein said acoustic tube axis is defined as a line intersecting said acoustic tube outlet center point and said loudspeaker diaphragm center point.

An acoustic tube outlet may be an opening of the acoustic tube (e.g., an opening of the device housing), where acoustic sound produced by the loudspeaker is channeled away from the device housing and into the ear canal of the user wearing the in-ear headphone device. Accordingly, the acoustic tube outlet may be the part of the device housing that bridges the front acoustic cavity and the ear canal. The acoustic tube outlet may be an acoustic tube segment of the acoustic tube, which is positioned furthest away from the loudspeaker of the in-ear headphone device, compared with other acoustic tube segments of the acoustic tube.

The acoustic tube outlet may be associated with an acoustic tube outlet center point, which may define a center point of the ear-canal facing end of the acoustic tube. A center point may be a geometrical center of the end of the acoustic tube, a point of symmetry or center of mass of the end of the acoustic tube. The acoustic tube outlet center may define a point of intersection with the acoustic tube axis.

The loudspeaker may be associated with a loudspeaker diaphragm center point, which may be a center of mass of the loudspeaker diaphragm, a geometrical center of the loudspeaker diaphragm, or a symmetry point of the loudspeaker diaphragm. The loudspeaker diaphragm center may define a point of intersection with the acoustic tube axis.

In some embodiments, the acoustic tube axis may include a line which intersects the acoustic tube outlet center point and the loudspeaker diaphragm center point.

In some embodiments, said acoustic tube axis may be perpendicular to an acoustic tube outlet plane defined by said acoustic tube outlet.

The acoustic tube outlet may define a plane (e.g., a plane including endpoint of the acoustic tube). As an example, the acoustic tube may terminate with an acoustic tube segment which is shaped as a hollow frustum, and in this example, the acoustic tube outlet plane may be a plane which coincides with one of the two geometrical planes defining the hollow frustum.

In some embodiments, a loudspeaker diaphragm axis may define a line of symmetry of said loudspeaker diaphragm, wherein said loudspeaker diaphragm axis may be parallel to said acoustic tube axis.

In some embodiments, the line of symmetry may be a line of rotational symmetry or a line of cylindrical symmetry. In some embodiments, the loudspeaker diaphragm may be cylindrically symmetric, and may thus define a loudspeaker diaphragm axis of cylindrical symmetry. In some embodiments, the loudspeaker diaphragm may have a rotational symmetry, and may thus define a loudspeaker diaphragm axis of rotational symmetry. These symmetries may be approximate. In some embodiments, the acoustic tube axis may be parallel to the loudspeaker diaphragm axis.

In some embodiments, said loudspeaker diaphragm may include a diaphragm translation axis and wherein said acoustic tube axis may be parallel to said diaphragm translation axis.

A diaphragm translation axis may be an axis along which the loudspeaker diaphragm may reciprocate to produce acoustic sounds.

In some embodiments, said loudspeaker may include a voice coil arranged to reciprocate said loudspeaker membrane along said diaphragm translation axis.

A typical loudspeaker (e.g., a dynamical loudspeaker) may include a voice coil which may reciprocate when an alternating current is applied to the voice coil. It is this reciprocating motion which moves the diaphragm to create sound. The reciprocating motion has a direction of translation (e.g., a direction in which it reciprocates back and forth). The diaphragm translation axis may include the direction of translation of the reciprocating motion of the voice coil.

In some embodiments, said loudspeaker may be associated with a loudspeaker axis and said microphone may be associated with a microphone axis, wherein an axis angle between said loudspeaker axis and said microphone axis may be in the range from 0 degree to 90 degrees (e.g., in the range from 0 degrees to 60 degrees, from 0 degree to 30 degrees, or in the range from 0 degree to 10 degrees).

In some embodiments, said loudspeaker axis may include said loudspeaker diaphragm axis.

In some embodiments, said loudspeaker axis may include said diaphragm translation axis.

In some embodiments, said loudspeaker axis may be arranged along a direction of maximum sound intensity of said loudspeaker.

Generally, a loudspeaker has a characteristic radiation pattern. In some angular directions, it may emit greater sound wave intensities than in other angular directions. In some embodiments, the loudspeaker axis may be defined by the direction in which the loudspeaker emits its maximum sound wave intensity at a given frequency of sound, such as at a frequency selected from mid-to-high frequencies (e.g., a frequency selected from the range of frequencies from 250 Hz to 20 kHz).

When referring to a characteristic radiation pattern of a loudspeaker, it may include a radiation pattern with minimal influence on other components. For example, the radiation pattern of a loudspeaker may be the radiation pattern of a loudspeaker emitting sound into open space void of any nearby obstacles.

In some preferred embodiments, the loudspeaker and the microphone may have similar orientations. For example, the angle between their respective orientations may be substantially zero. The orientations of the loudspeaker and the microphone may, for example, include their directions of maximum sound intensity and sound sensitivity, respectively. Alternatively, the orientations of the loudspeaker and the microphone may include the directions of translations of the loudspeaker diaphragm and the microphone transducer, respectively.

In some embodiments, said microphone axis may be arranged along a direction of maximum sound sensitivity of said microphone.

A microphone may have a characteristic sensitivity pattern. A characteristic radiation pattern may also be referred to as a pickup pattern. Such a pattern may indicate the directional sensitivity of the microphone. In some angular directions, it may be more sensitive than in some other angular directions. In some embodiments, the microphone axis may be defined by the direction in which the microphone is most sensitive to incoming sound waves.

When referring to a characteristic sensitivity pattern of a microphone, it may be a sensitivity pattern with minimal influence of other components. For example, the sensitivity pattern of a microphone may be the sensitivity pattern of a microphone located in open space void of any nearby obstacles. A characteristic sensitivity pattern of a microphone may be analogized to a characteristic radiation pattern of a loudspeaker.

In some embodiments, said microphone axis may be an axis of translation of said microphone transducer.

An axis of translation of said microphone transducer may be an axis along which the microphone transducer may reciprocate in response to an incoming acoustic sound. This axis of translation may be an axis of translation of a voice coil if the microphone is based on a voice coil. Alternatively, the axis of translation of said microphone may be an axis perpendicular to two parallel capacitor plates if the microphone is a condenser microphone.

In some embodiments, said loudspeaker diaphragm may be associated with a loudspeaker diaphragm extension range along said acoustic tube axis, wherein said microphone transducer may be associated with a microphone transducer extension range along said acoustic tube axis, and wherein said loudspeaker diaphragm extension range and said microphone transducer extension range may be overlapping at least partly along said acoustic tube axis.

A loudspeaker diaphragm extension range may be a projection of said loudspeaker diaphragm onto said acoustic tube axis. A microphone transducer extension range may be a projection of said microphone transducer onto said acoustic tube axis.

In some embodiments, the loudspeaker and the microphone may be arranged according to certain criteria along the acoustic tube axis, for example the diaphragm of the loudspeaker and the microphone transducer may be arranged side by side in such a way that projections of the two onto the acoustic tube axis are overlapping at least partly or overlapping fully.

A partial or full overlap of the loudspeaker diaphragm extension range and the microphone transducer extension range may be achieved in an advantageous in-ear headphone device configuration in which the microphone transducer and loudspeaker diaphragm are placed side by side. This may ensure that the overall length of the in-ear headphone device, as measured from the ear canal and out, may be reduced, a greater fit of the in-ear headphone device, and a greater stability of the device.

In some embodiments, said loudspeaker diaphragm may be associated with a loudspeaker diaphragm extension range, wherein said microphone transducer may be associated with a microphone transducer extension range, and wherein said loudspeaker diaphragm extension range and said microphone transducer extension range may be displaced by a component extension displacement of from 0 millimetre to 10 millimetres (e.g., 2 millimetres) along said acoustic tube axis.

The loudspeaker and microphone may be arranged such that the loudspeaker diaphragm extension range and the microphone transducer extension range does not have an overlap along the acoustic tube axis. In such cases, the extension ranges may be displaced from each other along the acoustic tube axis by some distance, such as a component extension displacement ranging from 0 millimetre to 10 millimetres (e.g., from 0.1 millimetre to 8 millimetres or from 0.5 millimetre to 5 millimetres). For example, the extension may be 2 millimetres.

In some embodiments, said device housing may establish an acoustic housing barrier between an ear acoustic cavity and an external acoustic environment when said device housing is fitted into said outer ear of said user.

In some embodiments, the device may form an acoustic housing barrier when being worn. An acoustic housing barrier between two environments may include a substantially airtight partition between the two environments, such as an airtight partition between the exterior of the in-ear headphone device (e.g., a surrounding sound environment) and the ear acoustic cavity defined by the front acoustic cavity and the ear canal.

Establishing an acoustic housing barrier between said ear acoustic cavity and said external acoustic environment may be advantageous in that acoustic sounds from the external acoustic environment may be attenuated on their way into the ear acoustic cavity. Such an attenuation may also be referred to as passive noise control. Embodiments of the disclosure that include an acoustic housing barrier may thus employ both passive noise control as well as active noise control.

In some embodiments, said device housing may include an acoustic leak path.

An acoustic leak path may include an opening in the device housing or an acoustic channel coupling the front acoustic cavity to the external acoustic environment. The acoustic leak path thus allows sound in the front acoustic cavity to leak or vent into the external acoustic environment. A device housing including an acoustic leak path may be advantageous in that the occlusion effect may be reduced passively. The occlusion effect is an effect which arises when the ear canal is blocked and is most pronounced when the user speaks. The user's own speech may be carried by his/her jawbone in the form of vibrations which may in turn vibrate the ear canal and create standing sound waves within the occluded/blocked ear canal. The user will thus experience muffled, echoed, or distorted replication of his/her own voice when speaking and wearing an occluding device. This effect can be reduced by using an acoustic leak path which may vent these sounds out of the front acoustic cavity and ear canal.

In some embodiments, said acoustic leak path may be a controllable acoustic leak path.

The acoustic leak path may be a controllable (e.g., adjustable) leak path. Being "adjustable" may be that the geometry of the leak path may be adjusted. For example, the geometry may include the width of the leak path, or a size of an opening of the leak path. In some embodiments, adjusting the size of the opening of the leak path may be realized by an electronically operated shutter. Using a controllable acoustic leak path may be advantageous in that the in-ear headphone device may vent out sounds sometimes, while not at other times. For example, the controllable acoustic leak path may be controllable or adjustable between two states: a fully closed state where no sound can be vented through and a fully open state which allows as much sound as possible to be vented through. Being able to open the controllable leak path may be advantageous in some situations where the user of the in-ear headphone device intends to listen to music while in the meantime being able to communicate with his/her own voice without experiencing the occlusion effect. Likewise, being able to fully close the controllable acoustic leak path is advantageous when the user only wants to listen to music and experience the best possible active or passive noise control.

In some embodiments, said acoustic leak path may include an acoustic damping element.

A damping element may include an element arranged to attenuate sounds. The damping element may include, for example, a damping cloth or a mesh, such as a synthetic permeable mesh.

In some embodiments, said in-ear headphone device may include a loudspeaker assembly including said loudspeaker.

In some embodiments, said in-ear headphone device may include a microphone assembly including said microphone.

In some embodiments, said loudspeaker assembly and said microphone assembly may be a common assembly.

In some embodiments, said in-ear headphone device may further include an interface arranged to receive a feed audio signal.

In some embodiments, a feed audio signal may be provided to the in-ear headphone device, which can be emitted as sound by the loudspeaker. The feed audio signal may be provided from an external unit such as an audio source arranged to output an electrical audio signal and with connecting means to deliver the audio signal to the in-ear headphone device. Examples of connecting means may be wired connections (e.g., a cabled connection) and wireless connections (e.g., a Bluetooth connection, such as Bluetooth A2DP or Bluetooth aptX, or a Wi-Fi connection).

An audio signal may be a type of electronic signal. In some embodiments, the audio signal may be an analogue audio signal. In some embodiments, the audio signal may be a digital audio signal.

In some embodiments, said in-ear headphone device may include an internal power supply unit, such as a battery.

Various features of an in-ear headphone device with active noise control may include a power source, such as a power supply unit. The power supply unit may be an internal power supply unit included within the device housing of the in-ear headphone device.

In some embodiments, a processing unit may process an in-ear audio signal detected by the microphone and a feed audio signal received by the in-ear headphone device. The processing unit may provide both a noise cancelling audio signal and the feed audio signal to the loudspeaker. Such a processing unit may be coupled to a power source.

The in-ear headphone device may also include at least one amplifier coupled to a power source. For example, the at least one amplifier may amplify an audio signal to be provided to a loudspeaker.

In some embodiments, the power source included in the in-ear headphone device may be a battery. For example, the battery may be non-rechargeable, such as an alkaline battery, a zinc-air battery, or a silver-oxide battery. For another example, the battery may be rechargeable, such as a lead-acid battery, a lithium-ion battery, or a nickel metal hydride battery. It should be noted that the embodiments of the battery are not restricted to these examples.

Having an internal power supply unit may be advantageous in that the in-ear headphone device may be a true wireless device.

In some embodiments, the power supply unit (e.g., the battery) and/or other components of the in-ear headphone device may be external components, such as components which are positioned outside said device housing.

In some embodiments, said in-ear headphone device may include a processing unit, such as a central processing unit.

Active noise control may require one or more signals to be processed, for example, to provide a noise cancelling audio signal. In some embodiments, this processing of signals may be performed by a processing unit. A processing unit may be an analogue circuit, a digital circuit, a type of integrated circuit, or a signal processor, but is not restricted to these examples. The processing unit may be contained within the device housing of the in-ear headphone device.

In some embodiments, said processing unit may provide said noise cancelling audio signal on the basis of said in-ear audio signal detected by said microphone.

For a processing unit to provide a noise cancelling audio signal, in some embodiments, the microphone may provide a recording of unwanted noise.

In some embodiments, said processing unit may include a digital signal processor.

In some embodiments, said microphone may include a Micro-Electrical-Mechanical System microphone.

A Micro-Electrical-Mechanical System (MEMS) may include a type of technology relying on microscopic devices with moving parts. In the case of a MEMS microphone, the microphone transducer may be the moving part of the microphone and may be microscopic.

In some embodiments, said in-ear headphone device may include an auxiliary microphone.

The in-ear headphone device may include an auxiliary microphone (e.g., an extra microphone) besides the microphone that records sounds within the front acoustic cavity. The auxiliary microphone may be arranged to record sounds from the external acoustic environment. Such an auxiliary microphone may be advantageous because improved active noise control may be realized. It may be furthermore advantageous that the voice of the user of the in-ear headphone device may be better be recorded, which may enable voice control of the device or for telecommunication purposes.

In some embodiments, an in-ear headphone device set may include:

- a first in-ear headphone device according to any of the abovementioned embodiments;
- a second in-ear headphone device according to any of the abovementioned embodiments;
- wherein said first in-ear headphone device is arranged to be fitted into a first outer ear of a user; and
- wherein said second in-ear headphone device is arranged to be fitted into a second outer ear of said user.

In some embodiments, an in-ear headphone device set may include a first and a second in-ear headphone device, such that a user of the set may insert an in-ear headphone device into each of his/her outer ears. Thereby the user may experience stereo sounds as well as active noise control for each ear.

BRIEF DESCRIPTION OF THE DRAWINGS

Various embodiments of the disclosure will in the following be described with reference to the drawings where.

DETAILED DESCRIPTION

Figure 1A:
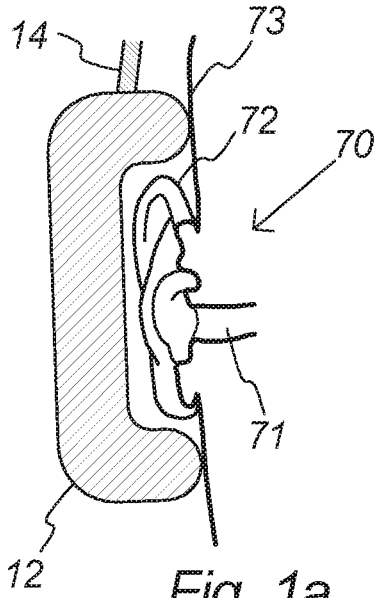
Fig. 1a (prior art)
FIGS. 1*a*-1*c* illustrate various types of conventional headphones having different sizes and/or fastening mechanisms.
Figure 1B:
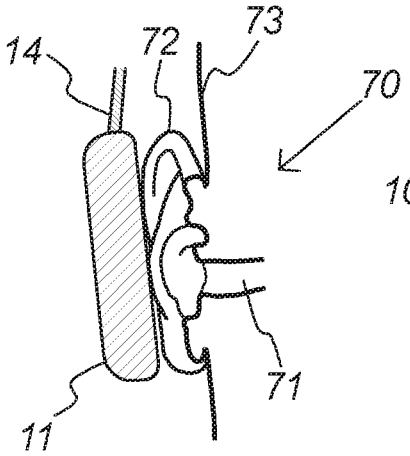
Fig. 1b (prior art)
Figure 1C:
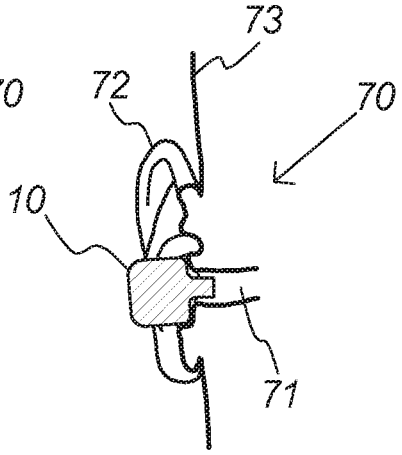
Fig. 1c (prior art)

FIGS. 1*a*-*c* illustrate various types of conventional headphones. Each type of headphone may have a different size and/or means of fastening the headphone to the ear of a user of the headphone.

FIG. 1*a* shows a conventional over-ear headphone device 12. An over-ear headphone device may also be referred to as a full-size headphone, a circumaural headphone, or an over-the-ear headphone. This type of headphone is typically substantially larger than the auricle 72 of a user wearing the headphone. The auricle is the visible part of the outer ear 70 and may also be referred to as pinna. An over-ear headphone device 12 is typically fastened to the head 73 of a user by using a band 14 which connects two over-ear headphone devices 12 (one for each ear) into a single device and applies a pressure onto the head of the user, in direction of the ear canal 71, which maintains the over-ear headphone in position. Fastening an over-ear headphone device do thereby not rely on a fit to the outer ear 70. Due to the size of the over-ear headphone device, it may primarily rest on the head of a user, surrounding the auricle 72 of a user when being worn.

FIG. 1*b* shows a conventional on-ear headphone device 11. An on-ear headphone device may also be referred to as supra-aural headphone. The on-ear headphone device 11 is typically fastened to the head 73 of a user by using a band 14, but the fastening is not restricted to a band. However, fastening an on-ear headphone device does not rely on a fit to the outer ear 70. Typically, the band 14 may push the on-ear headphone device 11 in a direction towards the ear canal 71. An on-ear headphone device typically has a size which is similar to the size of the auricle 72 and may primarily rest on the auricle 72 of a user when worn.

FIG. 1*c* shows a conventional in-ear headphone device 10. An in-ear headphone device may also be referred to as an earbud or a hearable.

As opposed to the over-ear headphone device 12 and the on-ear headphone device 11, the in-ear headphone device 10 is substantially smaller and relies on a fit to the outer ear 70 to be fastened. It typically extends at least partially into the ear canal 71 of a user.

A comparison of FIGS. 1*a*-1*c* shows that an in-ear headphone device 10 is significantly smaller than other types of headphone devices. Consequently, the acoustical environment within an in-ear headphone is very different from acoustical environments within other types of headphone devices. Additionally, the size of the in-ear headphone device 10 limits the variety of headphone components which may fit within the device.

Figure 2:
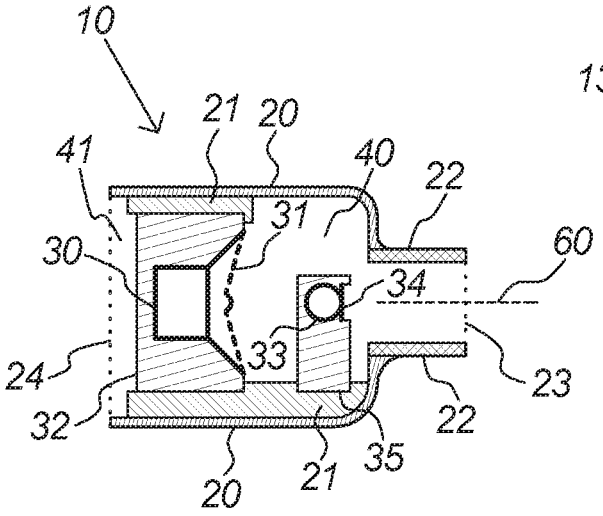
Fig. 2 (prior art)
FIG. 2 illustrates a conventional in-ear headphone device with active noise control including a loudspeaker and a microphone.

FIG. 2 shows a cut-through detailed partial view of a conventional in-ear headphone device 10 arranged for active noise control. The in-ear headphone device 10 includes a loudspeaker 30 and microphone 33. The in-ear headphone device may extend beyond the dividing line 24, beyond which additional electronic components may be housed. The loudspeaker 30 and microphone 33 are acoustically coupled within a front acoustic cavity 40 within a device housing 20. In FIG. 2, the loudspeaker 30 is mounted in a loudspeaker assembly 32 and, similarly, the microphone 33 is mounted in a microphone assembly 35. The loudspeaker 30 and the microphone 33 are mounted within the device housing 20 by transducer holders 21. When the device is worn, the front acoustic cavity 40 is acoustically coupled to an ear canal 70 of a user by an acoustic tube 22. The device has a characteristic acoustic tube axis 60 which extends into the ear canal of the user wearing the device.

The loudspeaker 30 and the microphone 33 of the in-ear headphone device 10 are placed in front of each other along the acoustic tube axis 60. They may have various orientations and may not necessarily be centered on the acoustic axis 60, but when the device is viewed along the acoustic tube axis 60, the microphone transducer 34 is at least partially in front of the loudspeaker diaphragm 31 or the loudspeaker diaphragm 31 is at least partially in front of the microphone transducer 34.

Figure 3:
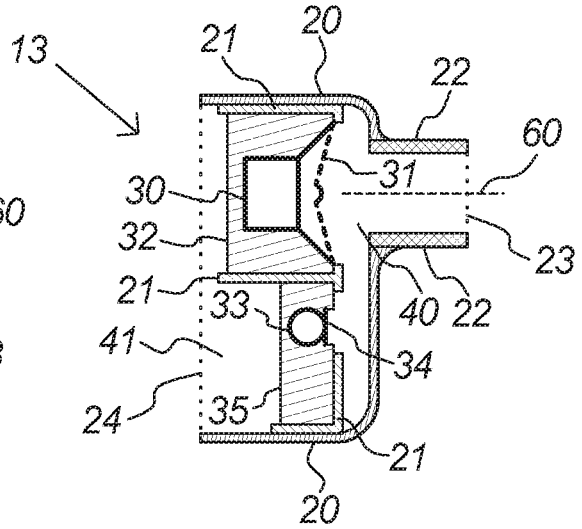
FIG. 3 illustrates an example in-ear headphone device with active noise control including a loudspeaker and a microphone according to some embodiments of this disclosure.

FIG. 3 shows a cut-through partial view of an example in-ear headphone device 13 arranged for active noise control, according to some embodiments of this disclosure.

The in-ear headphone device 13 includes a loudspeaker 30 and a microphone 33, as shown in FIG. 3, however the device may extend beyond the dividing line 24 and may thus additionally include other components, such as a battery, an audio interface, or a processing unit (not shown in FIG. 3). The loudspeaker 30 and microphone 33 may be acoustically coupled in a front acoustic cavity 40 within a device housing 20. The front acoustic cavity may be is defined by the device housing 20 and include the volume in front of the loudspeaker 30 and microphone 33 contained within the housing 20, and the volume within an acoustic tube 22 of the in-ear headphone device 13. The front acoustical cavity 40 is not acoustically coupled to a rear acoustic cavity 41 that is a volume defined in part by the device housing 20 and may contain other electronic components as described above. In FIG. 3, it is possible to ensure a substantially air-tight closure with the ear canal of a user of the in-ear headphone device once the device is fitted in to the user's outer ear.

As shown in FIG. 3, the loudspeaker 30 is mounted in a loudspeaker assembly 32. However, the loudspeaker may be mounted in other ways according to other embodiments of this disclosure. Similarly, the microphone 33 is mounted in a microphone assembly 35. However, the loudspeaker may be mounted in other ways according to other embodiments of the disclosure. The loudspeaker 30 and the microphone 33 are mounted within the device housing 20 by use of transducer holders 21. In some embodiments, the loudspeaker 30 and microphone 33 are not mounted by use of transducer holders but may instead be mounted directly to the device housing 20. When the device is worn, the front acoustic cavity 40 is acoustically coupled to an ear canal 71 of a user by an acoustic tube 22 to form an ear acoustic cavity (e.g., an enclosed volume defined by the ear canal 71 and the front acoustic cavity 40). The front acoustic cavity 40 further includes the volume present within the acoustic tube 22 but not extending beyond an acoustic tube outlet 23, which may be visualized as a plane defining end points of the acoustic tube 22.

In FIG. 3, the device has a characteristic acoustic tube axis 60 extending from within the front acoustic cavity 40 and into the ear canal of a user once the device is fitted into the user's outer ear. In this example, the acoustic tube axis 60 may be a center axis of the acoustic tube 22.

A difference between FIG. 2 and FIG. 3 is the arrangement of the loudspeaker 30 and the microphone 33 relative to the acoustic tube axis 60. In FIG. 3, when the device is viewed along the acoustic tube axis 60, the loudspeaker diaphragm 31 and the microphone transducer 34 are non-intersecting. For example, along the acoustic tube axis 60, the loudspeaker diaphragm 31 is not in front of the microphone transducer 34 and the microphone transducer 34 is not in front of the loudspeaker diaphragm 31. In some embodiments, the loudspeaker and microphone may be arranged in a side-by-side configuration as shown in FIG. 3.

Comparing with the in-ear headphone device 10 in FIG. 2, the in-ear headphone device 13 in FIG. 3 may have the position of the loudspeaker 30 significantly closer to the ear canal 71 of a user, and have the volume of the front acoustic cavity 40 smaller. Both these features may be advantageous for sound quality and active noise control, as well as the stability of the device. The size of the device housing 20 along the acoustic tube axis 60 may be significantly reduced by the present disclosure, which improves the stability of the in-ear headphone device when it is worn, because it relies on a fit with the outer ear of a user. Furthermore, the closer components of the device 13 can be placed to the ear canal 71 of the user, the more the center of mass of the device is placed close to the ear canal 71. which has the benefit that the device becomes less likely to fall out of the ear of the user during use (e.g., during sports activities).

Figure 4:
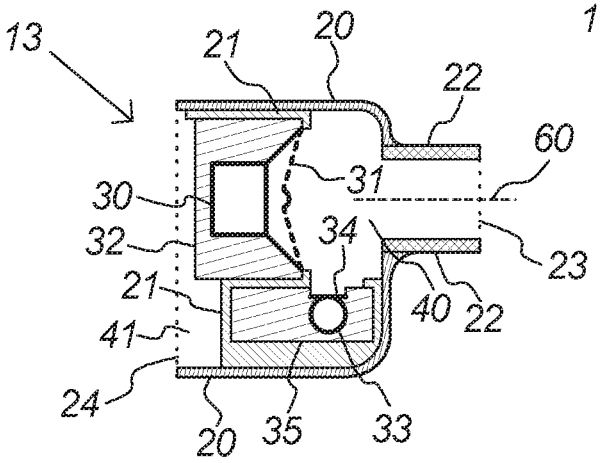
FIG. 4 illustrates an example in-ear headphone device with active noise control including a loudspeaker and a microphone according to some embodiments of this disclosure.

FIG. 4 shows a cut-through partial view of an example in-ear headphone device 13 arranged for active noise control, according to some embodiments of this closure. The in-ear headphone device 13 in FIG. 4 may include acoustically coupled loudspeaker 30 and microphone 33. FIG. 4 may be similar to FIG. 3 except the orientation of the microphone. In FIG. 4, the microphone 33 points in a direction perpendicular to the acoustic tube axis 60. In contrast, in FIG. 3, both the loudspeaker 30 and microphone 33 points in a direction parallel to the acoustic tube axis 60.

Notably, in FIG. 4, the loudspeaker diaphragm 31 and the microphone transducer 34 are arranged relative to the acoustic tube axis 60 such that projected areas of the two onto a component projection plane (not shown) are non-intersecting. Projections of components onto a component projection plane are shown in detail in FIG. 7.

Figure 5:
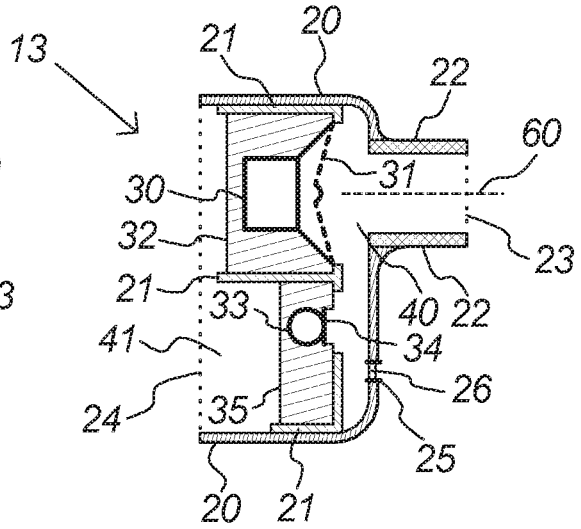
FIG. 5 illustrates an example in-ear headphone device with active noise control including an acoustic leak path according to embodiments of this disclosure.

FIG. 5 shows a cut-through partial view of an example in-ear headphone device 13 arranged for active noise control, according to embodiments of this disclosure. The in-ear headphone device 13 in FIG. 5 may include acoustically coupled loudspeaker 30 and microphone 33. FIG. 5 may be similar to FIG. 3 except that the in-ear headphone device 13 further includes an acoustic leak path 25 disposed on the device housing 20. The acoustic leak path 25 further includes an acoustic damping element 26. It should be noted that, in some embodiments, the acoustic leak path 25 may include no acoustic damping element (e.g., the acoustic damping element 26).

When a user wears an in-ear headphone device, the speech of the user may be perceived by the user as as muffled, echoed, or distorted. This is also known as the "occlusion effect." To reduce or eliminate this effect, the in-ear headphone device 13 of the present disclosure may include an acoustic leak path 25 (e.g., as shown in FIG. 5). The acoustic properties of the ear acoustic cavity and the acoustic leak path 25 may be altered by including an acoustic damping element 26, which may transmit sound differently than the acoustic leak path 25 and the device housing 20.

Figure 6:
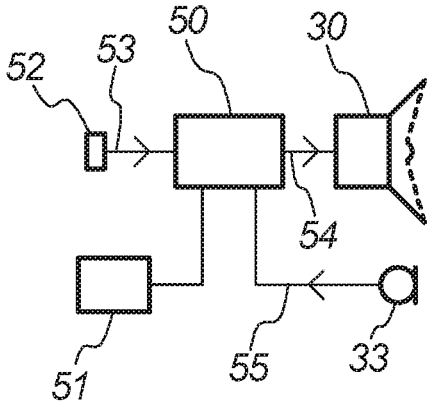
FIG. 6 illustrates an example circuit diagram of an active noise control system according to some embodiments of the this disclosure.

FIG. 6 shows a schematic view of an example active noise control circuit, according to some embodiments of the disclosure. The active noise control circuit may eliminate any unwanted noise in the vicinity of the loudspeaker 30 using a noise cancelling audio signal in accordance with the principle of destructive interference.

In FIG. 6, a microphone 33 may detect or record a signal on the basis of unwanted noise within the ear acoustic cavity and on the basis of the recorded signal. A microphone audio signal 55 may be provided to a processing unit 50. In an example, the processing unit 50 may be a digital signal processor. The processing unit 50 may also receive a feed audio signal 53 provided to the in-ear headphone device via an interface 52. The processing unit 50 may be powered by a power supply unit 51 (e.g., a battery).

Based on the feed audio signal 53 and the microphone audio signal 55, the processing unit 50 may generate a noise cancelling audio signal. Ideally, the noise cancelling audio signal is similar to the additive inverse of the unwanted noise when emitted by the loudspeaker. The processing unit 50 may provide a loudspeaker audio signal 54 to a loudspeaker 30. The loudspeaker audio signal 54 may include the noise cancelling audio signal and may be a combination (e.g., a linear combination) of the noise cancelling audio signal and the feed audio signal.

In some embodiments, the output of the loudspeaker 30 may include sound that cancels unwanted noise in the ear canal of a user, and may further include sound on the basis of the feed audio signal 53.

In some embodiments, when active noise control is activated, the amplitude of the unwanted noise may be effectively reduced, and, similarly, the recorded amplitude of the unwanted sound may be reduced, because the loudspeaker 30 and the microphone 33 are acoustically coupled. However, to maintain a reduced amplitude of the unwanted noise, the amplitude of the noise cancelling audio signal should not be reduced. The processing unit may be designed to compensate for a reduction of the amplitude of the recorded unwanted noise, such that the noise cancelling audio signal may not be reduced in amplitude when the unwanted noise is reduced in amplitude due to active noise control.

Figure 7A:
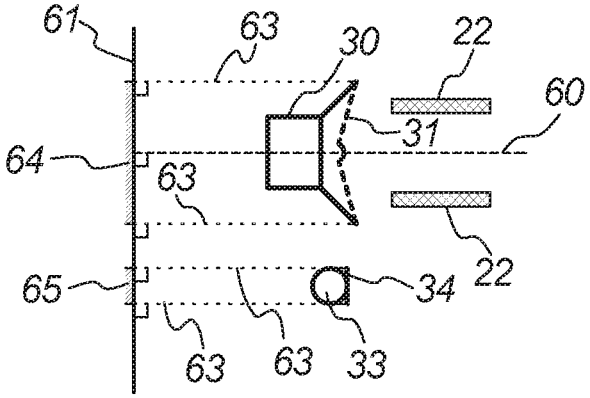
FIGS. 7*a*-7*b* illustrate diagrammatic representations of example loudspeaker and microphone placements relative to an acoustic tube axis according to some embodiments of this disclosure.
Figure 7B:
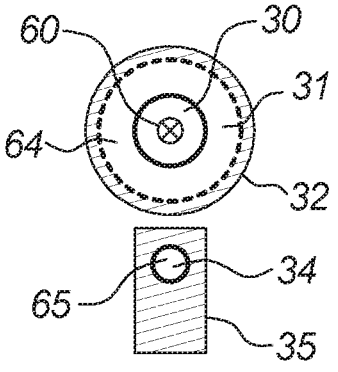

FIGS. 7*a*-7*b* illustrate the principle of the loudspeaker 30 and the microphone 33 placement according to some embodiments of this disclosure. FIG. 7*a* illustrates a view which is perpendicular to the acoustic tube axis 60, whereas FIG. 7*b* illustrates a view parallel to the acoustic tube axis 60.

FIG. 7*a* may be a simplified representation of FIG. 3 and show the acoustic tube 22, the loudspeaker 30, and the microphone 33. In addition, for explanatory and definition purposes, FIG. 7*a* also illustrates a component projection plane 61, perpendicular to the acoustic tube axis 60. The loudspeaker diaphragm 31 is projected along projection lines 63 parallel to the acoustic tube axis 60, onto the component projection plane 61 to form a loudspeaker diaphragm projection area 64. By a similar projection along projection lines 63, the microphone transducer 34 forms a microphone transducer projection area 65. In some embodiments, the loudspeaker diaphragm projection area 64 and the microphone transducer projection area 65 are non-intersecting (e.g., non-overlapping).

FIG. 7*b* shows a representation of the same device configuration as shown in FIG. 7*a* but in a view along the acoustic tube axis 60. A loudspeaker 30 including a loudspeaker diaphragm 31 is shown. Along the direction of view, the loudspeaker diaphragm projection area 64 covers the same area as the loudspeaker diaphragm 31. Similarly, a microphone transducer 34 is shown, which covers the same area as a microphone transducer projection area 65. As clearly seen, the loudspeaker diaphragm projection area 64 and the microphone transducer projection area 65 are non-intersecting.

FIGS. 8*a*-8*d* illustrate the acoustic tube axis 60 according to some embodiments of this disclosure. The illustrations include a loudspeaker 30 and an acoustic tube 22. These two components may determine, alone or in combination, a direction of the acoustic tube axis 60.

Figure 8A:
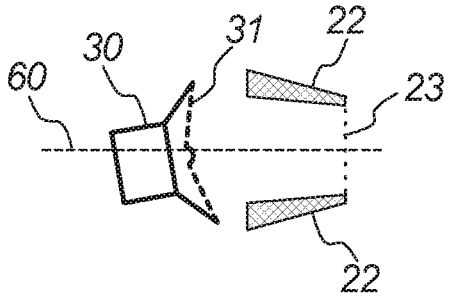
FIGS. 8*a*-8*d* illustrate various examples of acoustic tube axes according to some embodiments of this disclosure.

FIG. 8*a* shows an embodiment where the acoustic tube 22 includes an acoustic tube segment shaped as a hollow conical frustum. In FIG. 8*a*, the acoustic tube axis 60 may be the central axis of the acoustic tube segment shaped as a hollow conical frustum. The axis of the hollow conical frustum may be the axis of the cone upon which the hollow conical frustum is based, and the axis may be a straight line about which the cone has cylindrical symmetry. As seen in FIG. 8*a*, the acoustic tube axis 60 is an axis which passes through the acoustic tube segment.

Figure 8B:
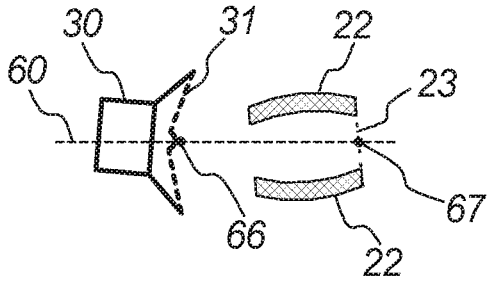

FIG. 8*b* shows another embodiment of the disclosure. In FIG. 8*b*, the loudspeaker diaphragm 31 has a loudspeaker diaphragm center point 66, and the acoustic tube 22 has an acoustic tube outlet 23 that has an acoustic tube outlet center point 67. The acoustic tube axis 60 may be a straight line that intersects the diaphragm center point 66 and the acoustic tube outlet center point 67. As seen in FIG. 8*b*, the acoustic tube axis 60 may be an axis which passes through the acoustic tube segment.

Figure 8C:
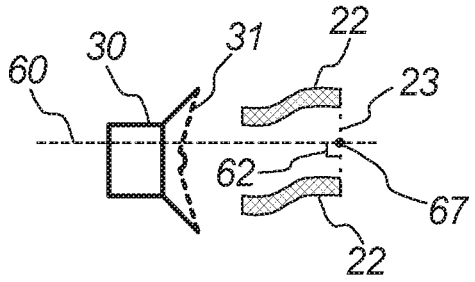

FIG. 8*c* shows another embodiment where the acoustic tube 22 has an acoustic tube outlet 23 that is approximately parallel to an acoustic tube outlet plane. In FIG. 8*c*, the acoustic tube axis 60 may be a straight line which is perpendicular to the acoustic tube outlet plane. It may additionally cross an acoustic tube outlet center point 67. As seen in FIG. 8*c*, the acoustic tube axis 60 is an axis which passes through the acoustic tube segment.

Figure 8D:
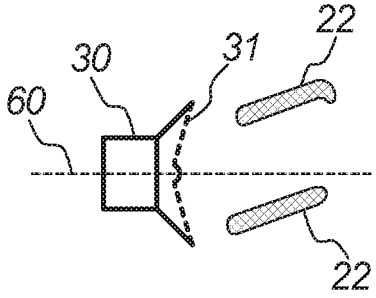

FIG. 8*d* shows yet another embodiment of the disclosure. In FIG. 8*d*, the loudspeaker diaphragm 31 has a loudspeaker diaphragm axis, which is defined as a symmetry axis of the loudspeaker diaphragm. For example, the symmetry may include cylindrical symmetry or rotational symmetry. In FIG. 8*d*, the acoustic tube axis 60 is the same as the loudspeaker diaphragm axis. In some other embodiments, the acoustic tube axis 60 may be an axis along which a voice coil of the loudspeaker may be arranged to reciprocate. As seen in FIG. 8*d*, the acoustic tube axis 60 may be an axis which passes through the acoustic tube segment.

Figure 9A:
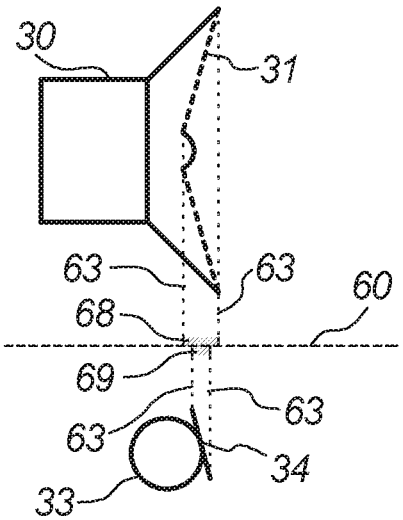
FIGS. 9*a*-9*b* illustrate various example arrangements of a loudspeaker and a microphone along an acoustic tube axis according to some embodiments of this disclosure.
Figure 9B:
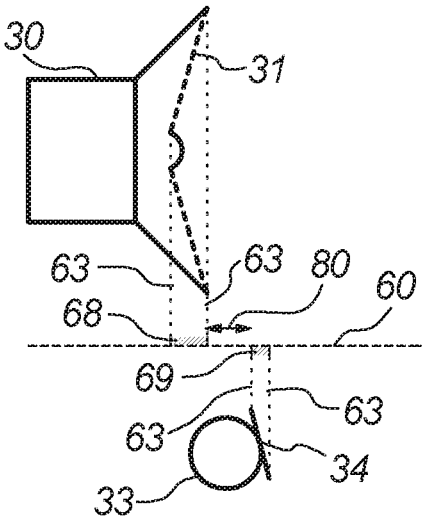

FIGS. 9*a*-9*b* show example arrangements of loudspeaker 30 and microphone 33 along the acoustic tube axis 60, according to some embodiments of this disclosure. Both figures show a loudspeaker diaphragm extension range 68 and a microphone transducer extension range 69, where both ranges may be obtained by projecting the loudspeaker diaphragm 31 and the microphone transducer 34 onto the acoustic tube axis 60, respectively. In FIGS. 9*a*-9*b*, the projections are illustrated using projection lines 63 as guides.

FIG. 9*a* shows a first arrangement of loudspeaker 30 and microphone 33, where the loudspeaker diaphragm extension range 68 and the microphone transducer extension range 69 has a full overlap along the acoustic tube axis 60. For example, the projection of the microphone transducer may be fully covered within the projection of the loudspeaker diaphragm.

FIG. 9*b* shows a second arrangement, where the loudspeaker diaphragm extension range 68 and the microphone transducer extension range 69 do not overlap along the acoustic tube axis 60. Instead, they are displaced along the axis by a component extension displacement 80.

According to other embodiments of the disclosure, the loudspeaker diaphragm extension range 68 and the microphone transducer extension range 69 may also have a partial overlap. For example, the loudspeaker 30 and the microphone 33 may be arranged such that the extension range of either component is only partially within the extension range of the other component and no extension range is fully within the extension range of another component.

LIST OF REFERENCE SIGNS

10, 13 In-ear headphone device
11 On-ear headphone device
12 Over-ear headphone device
14 Headphone band
20 Device housing
21 Transducer holder
22 Acoustic tube
23 Acoustic tube outlet
24 Dividing line
25 Acoustic leak path
26 Acoustic damping element
30 Loudspeaker
31 Loudspeaker diaphragm
32 Loudspeaker assembly
33 Microphone
34 Microphone transducer
35 Microphone assembly
40 Front acoustic cavity
41 Rear acoustic cavity
50 Processing unit
51 Power supply unit
52 Interface
53 Feed audio signal
54 Loudspeaker audio signal
55 Microphone audio signal
60 Acoustic tube axis
61 Component projection plane
62 Right angle
63 Projection line
64 Loudspeaker diaphragm projection area
65 Microphone transducer projection area
66 Loudspeaker diaphragm center point
67 Acoustic tube outlet center point
68 Loudspeaker diaphragm extension range
69 Microphone transducer extension range
70 Outer ear
71 Ear canal
72 Auricle
73 Head
80 Component extension displacement

The invention claimed is:

1. An in-ear headphone device comprising:

a device housing;

a loudspeaker; and a microphone, wherein said device housing is arranged to be fitted into an outer ear of a user such that said device housing extends into an ear canal of said user, wherein said microphone is configured to detect an in-ear audio signal, and wherein said in-ear headphone device is configured to process said in-ear audio signal to provide a noise cancelling audio signal to said loudspeaker, wherein said loudspeaker and said microphone are acoustically coupled within said device housing, wherein said device housing comprises an acoustic tube acoustically coupling said loudspeaker to said ear canal of said user when said device housing is fitted into said outer ear of said user, wherein said acoustic tube is associated with an acoustic tube axis extending into said ear canal, said acoustic tube axis defining a component projection plane perpendicular to said acoustic tube axis;

wherein said loudspeaker comprises a loudspeaker diaphragm associated with a loudspeaker diaphragm projection area, wherein said loudspeaker diaphragm projection area is defined as a projection of said loudspeaker diaphragm along said acoustic tube axis onto said component projection plane, wherein said microphone comprises a microphone transducer associated with a microphone transducer projection area, wherein said microphone transducer projection area is defined as a projection of said microphone transducer along said acoustic tube axis onto said component projection plane, wherein said loudspeaker diaphragm projection area and microphone transducer projection area are non-intersecting in said component projection plane, and wherein said loudspeaker is associated with a loudspeaker axis and said microphone is associated with a microphone axis, wherein an axis angle between said loudspeaker axis and said microphone axis is in a range from 0 degree to 60 degrees.

2. The in-ear headphone device according to claim 1, wherein said acoustic tube comprises an acoustic tube segment shaped as a hollow frustum, and said acoustic tube axis is an axis of said acoustic tube segment.

3. The in-ear headphone device according to claim 2, wherein said acoustic tube segment is shaped as a hollow conical frustum.

4. The in-ear headphone device according to claim 1, wherein said acoustic tube comprises an acoustic tube segment shaped as a hollow cylinder, and said acoustic tube axis is an axis of said acoustic tube segment.

5. The in-ear headphone device according to claim 1, wherein said acoustic tube comprises an acoustic tube outlet having a center point, wherein said loudspeaker diaphragm comprises a loudspeaker diaphragm center point, and wherein said acoustic tube axis is defined as a line intersecting said acoustic tube outlet center point and said loudspeaker diaphragm center point.

6. The in-ear headphone device according to claim 5, wherein said acoustic tube axis is perpendicular to an acoustic tube outlet plane defined by said acoustic tube outlet.

7. The in-ear headphone device according to claim 1, wherein a loudspeaker diaphragm axis defines a line of symmetry of said loudspeaker diaphragm, and wherein said loudspeaker diaphragm axis is parallel to said acoustic tube axis.

8. The in-ear headphone device according to claim 1, wherein said loudspeaker diaphragm comprises a diaphragm translation axis and wherein said acoustic tube axis is parallel to said diaphragm translation axis.

9. The in-ear headphone device according to claim 1, wherein said loudspeaker comprises a voice coil arranged to reciprocate said loudspeaker membrane along said diaphragm translation axis.

10. The in-ear headphone device according to claim 1, wherein said loudspeaker axis is said loudspeaker diaphragm axis.

11. The in-ear headphone device according to claim 1, wherein said loudspeaker axis is said diaphragm translation axis.

12. The in-ear headphone device according to claim 1, wherein said loudspeaker axis is arranged along a direction of maximum sound intensity of said loudspeaker.

13. The in-ear headphone device according to claim 1, wherein said microphone axis is arranged along a direction of maximum sound sensitivity of said microphone.

14. The in-ear headphone device according to claim 1, wherein said microphone axis is an axis of translation of said microphone transducer.

15. The in-ear headphone device according to claim 1, wherein said loudspeaker diaphragm is associated with a loudspeaker diaphragm extension range along said acoustic tube axis, wherein said microphone transducer is associated with a microphone transducer extension range along said acoustic tube axis, and wherein said loudspeaker diaphragm extension range and said microphone transducer extension range are overlapping at least partly along said acoustic tube axis.

16. The in-ear headphone device according to claim 1, wherein said loudspeaker diaphragm is associated with a loudspeaker diaphragm extension range, wherein said microphone transducer is associated with a microphone transducer extension range, wherein said loudspeaker diaphragm extension range and said microphone transducer extension range are displaced by a component extension displacement of from 0 millimetre to 10 millimetres along said acoustic tube axis.

17. The in-ear headphone device according to claim 1, wherein said device housing establishes an acoustic housing barrier between an ear acoustic cavity and an external acoustic environment when said device housing is fitted into said outer ear of said user.

18. The in-ear headphone device according to claim 1, wherein said device housing comprises an acoustic leak path or a controllable acoustic leak path.

19. The in-ear headphone device according to claim 18, wherein said acoustic leak path comprises an acoustic damping element.

20. The in-ear headphone device according to claim 1, wherein said in-ear headphone device comprises a loudspeaker assembly comprising said loudspeaker, and wherein said in-ear headphone device comprises a microphone assembly comprising said microphone.

21. The in-ear headphone device according to claim 20, wherein said loudspeaker assembly and said microphone assembly are a common assembly.

22. The in-ear headphone device according to claim 1, wherein said in-ear headphone device further comprises an interface configured to receive a feed audio signal.

23. The in-ear headphone device according to claim 1, wherein said in-ear headphone device comprises an internal power supply unit or a battery.

24. The in-ear headphone device according to claim 1, wherein said in-ear headphone device comprises a processing unit, a central processing unit, or a digital signal processor.

25. The in-ear headphone device according to claim 24, wherein said processing unit provides said noise cancelling audio signal based on said in-ear audio signal detected by said microphone.

26. The in-ear headphone device according to claim 1, wherein said microphone comprises a Micro-Electrical-Mechanical System microphone.

27. The in-ear headphone device according to claim 1, wherein said in-ear headphone device comprises an auxiliary microphone.

28. An in-ear headphone device set comprising:

a first in-ear headphone device according to claim 1;

a second in-ear headphone device according to claim 1;

wherein said first in-ear headphone device is arranged to be fitted into a first outer ear of a user; and wherein said second in-ear headphone device is arranged to be fitted into a second outer ear of said user.

29. An in-ear headphone device comprising:

a device housing;

a loudspeaker; and a microphone, wherein said device housing is arranged to be fitted into an outer ear of a user such that said device housing extends into an ear canal of said user, wherein said microphone is configured to detect an in-ear audio signal, and wherein said in-ear headphone device is configured to process said in-ear audio signal to provide a noise cancelling audio signal to said loudspeaker, wherein said loudspeaker and said microphone are acoustically coupled within said device housing, wherein said device housing comprises an acoustic tube acoustically coupling said loudspeaker to said ear canal of said user when said device housing is fitted into said outer ear of said user, wherein said acoustic tube is associated with an acoustic tube axis extending into said ear canal, said acoustic tube axis defining a component projection plane perpendicular to said acoustic tube axis, wherein said loudspeaker comprises a loudspeaker diaphragm associated with a loudspeaker diaphragm projection area, wherein said loudspeaker diaphragm projection area is defined as a projection of said loudspeaker diaphragm along said acoustic tube axis onto said component projection plane, wherein said microphone comprises a microphone transducer associated with a microphone transducer projection area, wherein said microphone transducer projection area is defined as a projection of said microphone transducer along said acoustic tube axis onto said component projection plane, wherein said loudspeaker diaphragm projection area and microphone transducer projection area are non-intersecting in said component projection plane, and wherein said loudspeaker and said microphone point in a direction parallel to said acoustic tube axis.

* * * * *